United States Patent [19]

Morris

[11] 4,378,822

[45] Apr. 5, 1983

[54] SPIRAL BINDING MACHINE FOR SPIRALLY FEEDING A SPIRAL BINDING ELEMENT

[75] Inventor: Leslie J. Morris, Farnham, England

[73] Assignee: Morris Brothers (Aldershot) Limited, Aldershot, England

[21] Appl. No.: 391,449

[22] Filed: Jun. 23, 1982

Related U.S. Application Data

[63] Continuation of Ser. No. 129,702, Mar. 12, 1980, abandoned.

[30] Foreign Application Priority Data

Mar. 19, 1979 [GB] United Kingdom ..... 7909603
Aug. 24, 1979 [GB] United Kingdom ..... 7929491

[51] Int. Cl.[3] ..... B21F 45/16
[52] U.S. Cl. ..... 140/92.3
[58] Field of Search ..... 140/92.3, 92.4, 92.9, 140/92.93, 92.94; 11/1 R, 1 A; 29/240.5

[56] References Cited

U.S. PATENT DOCUMENTS

| | | | |
|---|---|---|---|
| 770,722 | 9/1904 | Johanson | 140/92.3 |
| 2,532,443 | 12/1950 | Freundlich | 140/92.3 |
| 2,808,079 | 10/1957 | Tauber | 140/92.3 |
| 3,134,406 | 5/1964 | Freundlich et al. | 140/92.3 |

FOREIGN PATENT DOCUMENTS 711288 6/1954 United Kingdom .

*Primary Examiner*—Howard N. Goldberg
*Assistant Examiner*—Fred A. Silverberg
*Attorney, Agent, or Firm*—Wenderoth, Lind & Ponack

[57] ABSTRACT

A machine is disclosed for spirally feeding a spiral binding element. A mandrel guides the element. A driving wheel rotates the element on the mandrel. A location member engages in the element's spiral whereby the element is fed along the mandrel when the driving wheel rotates the element.

13 Claims, 6 Drawing Figures

SPIRAL BINDING MACHINE FOR SPIRALLY FEEDING A SPIRAL BINDING ELEMENT

This application is a continuation of application Ser. No. 129,702, filed Mar. 12, 1980, now abandoned.

The present invention relates to a spiral binding machine.

In a spiral binding machine a spiral binding element is rotated and thereby spirally threaded through perforations provided in a row along the edge of sheets to be bound.

A spiral binding machine according to the invention comprises a mandrel for guiding a spiral binding element received thereon, a driving wheel mounted in the machine for rotating the element on the mandrel by gripping the element between the driving wheel and the mandrel, the periphery of the driving wheel being adapted for frictional engagement with the element, a location member extending laterally of the mandrel for locating the element longitudinally of the mandrel and means for rotating the driving wheel to rotate the element on the mandrel thereby causing the element to be fed along the mandrel by cooperation of the element's spiral and the location member.

Although it is envisaged that the axis about which the driving wheel is rotated may be fixed, it is preferred that it be displaceable away from the mandrel. This permits ready initial feeding of the spiral binding element along the mandrel into the position where it is engaged by the driving wheel. To return the driving wheel to its driving position and enhance its frictional engagement with the element, means is preferably provided for biasing the wheel towards the mandrel.

The wheel is conveniently arranged for displacement by being supported on a swinging arm via an axle journalled in the arm. In one spiral binding machine described in more detail below, the swinging arm is itself journalled on a pivot shaft which is rotated for rotation of the driving wheel, drive being transmitted to the driving wheel via a gear wheel attached to a support shaft and meshed with a pinion attached to the driving wheel axle. When the machine is not in use the swinging arm hangs down from the pivot shaft with the driving wheel clear of the mandrel. Rotation of the pivot shaft biases the swinging arm, due to frictional drag, so that the driving wheel is moved into contact with the spiral binding element. In another machine described in more detail below, a swinging arm is also used and hangs down from a pivot shaft. In this machine a counterweight is provided to normally bias the driving wheel towards the spiral binding element. The counterweight could be replaced by a biasing spring. With this arrangement it is not strictly necessary for the pivot shaft to be above the driving wheel. It could be positioned further down or to either side. However, its position at the top of the arm facilitates fine balancing of the arm to provide a desirably small biasing force between the driving wheel and the spiral binding element.

In this machine, the driving wheel is knurled to enhance its frictional engagement with the spiral binding element. It may however have a rubber tire or other high friction material on its periphery. Preferably the length of the wheel is such as to engage two successive turns of the spiral binding element.

Although the location member need not be fixed to the pin, it preferably is and supports the mandrel in the binding machine. In the machines described below a single location member is provided; more than one member may be provided. In one machine the member is a pin having a diameter corresponding to the axial gap between two adjacent turns of the spiral binding element. This is not strictly necessary. As the element is fed along, it is thrust back against the member which only engages it on one side.

Where, as is preferred, the machine has a table for supporting a stack of sheets to be bound it is desirable that the table has fixed or adjustable guides against which the sheets to be bound can be placed to bring the first perforation into position to be entered by the point of the element as it advances spirally from the locating member. The perforations have, of course, the same pitch as the spiral binding element, thus the positioning of succeeding perforations is less critical. After the initial few perforations have been entered, they guide the element to succeeding perforations.

A single diameter mandrel can be employed for threading various diameters of spiral binding elements. For any diameter appreciably greater than that of the mandrel, the driving wheel will force the element to become eccentric of the mandrel. Thus, as preferably arranged, positioning of the driving wheel's central axis (when driving) in a plane which inclines downwardly from the central axis of the mandrel causes the central axis of the spiral binding element to be raised above that of the mandrel in the same plane. Consequently, successively larger diameter elements will be driven at successively higher levels. This arrangement enables the varying numbers of sheets to be bound with the appropriate diameter binding element without the necessity to adjust the height of the table supporting the sheets to be bound.

To help understand of the invention, two specific embodiments thereof will now be described with reference to the accompanying drawings in which.

Figure 1:
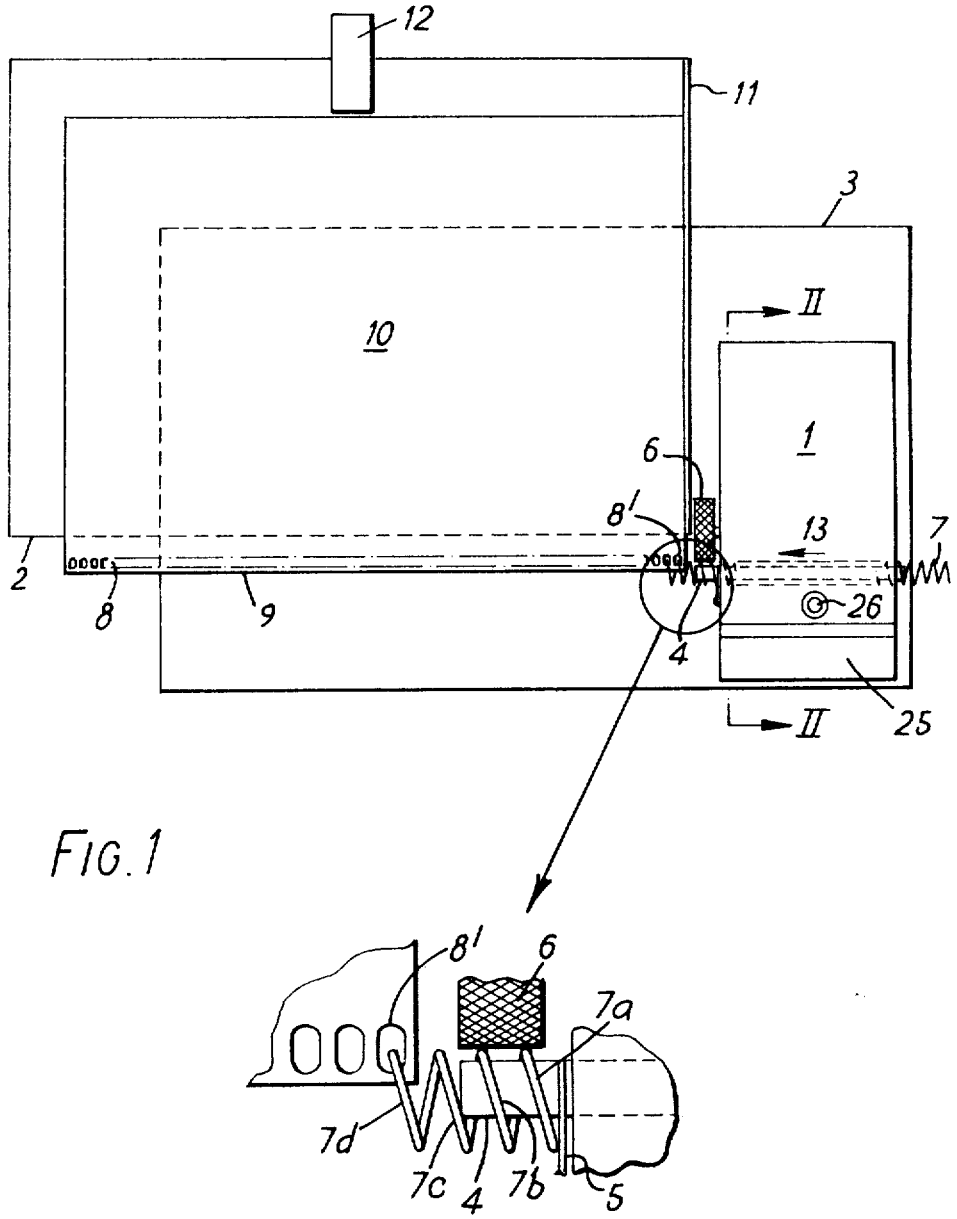
FIG. 1 is a plan view of a spiral binding machine according to the invention.
Figure 2:
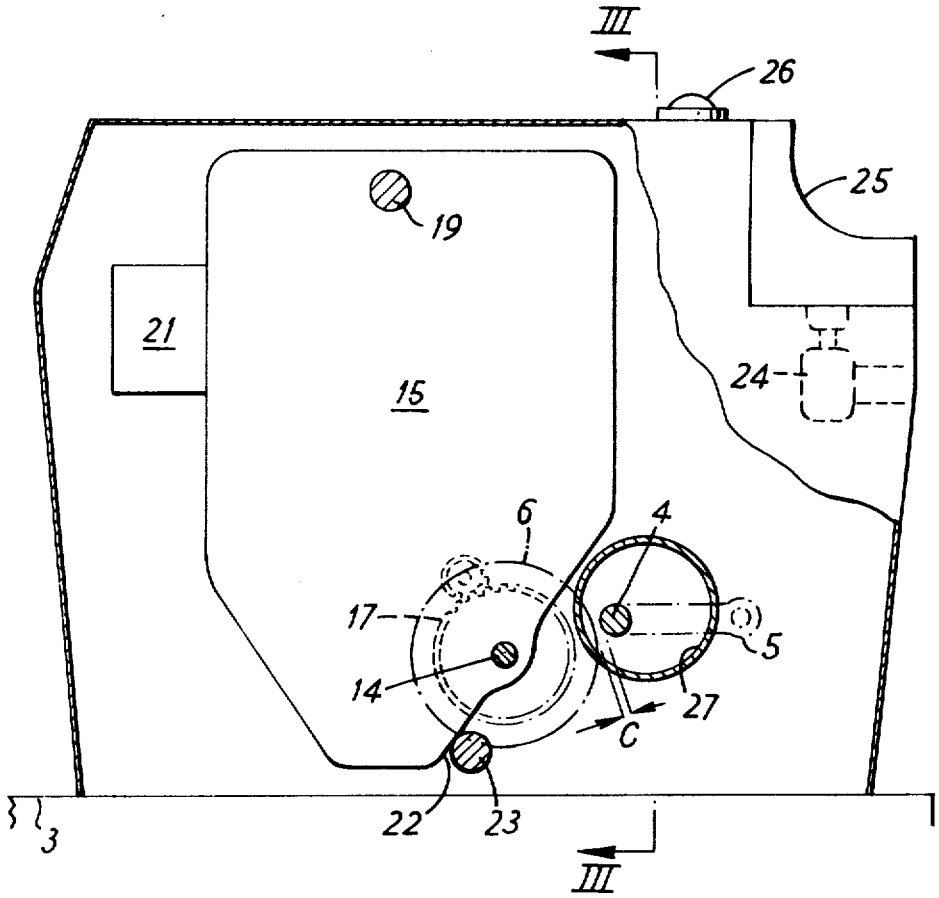
FIG. 2 is an end elevational cross-section on the line II—II in FIG. 1.
Figure 2A:
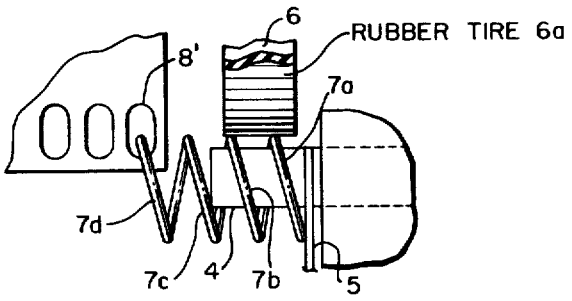
Figure 3:
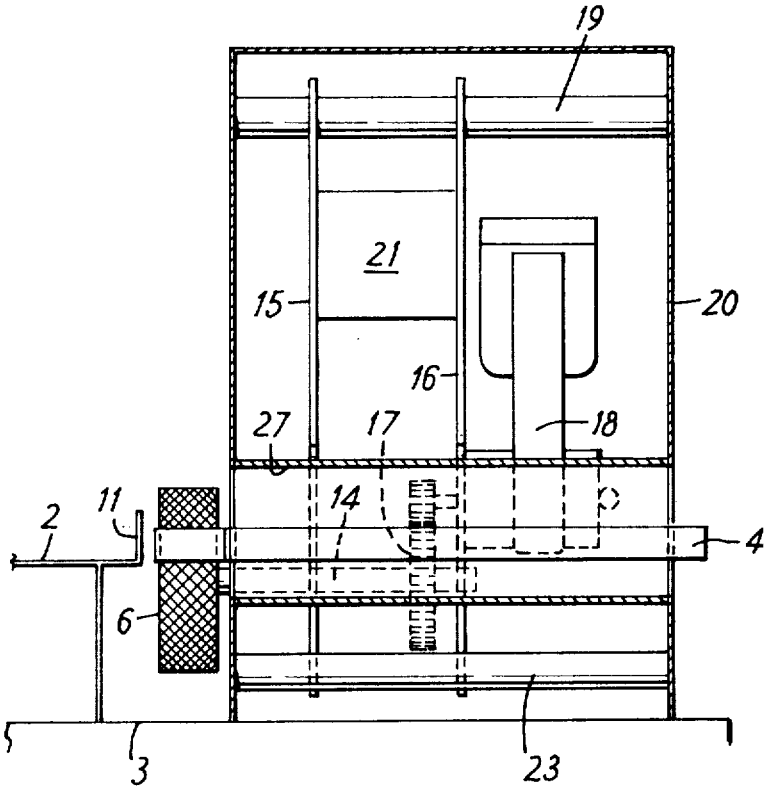
Figure 4:
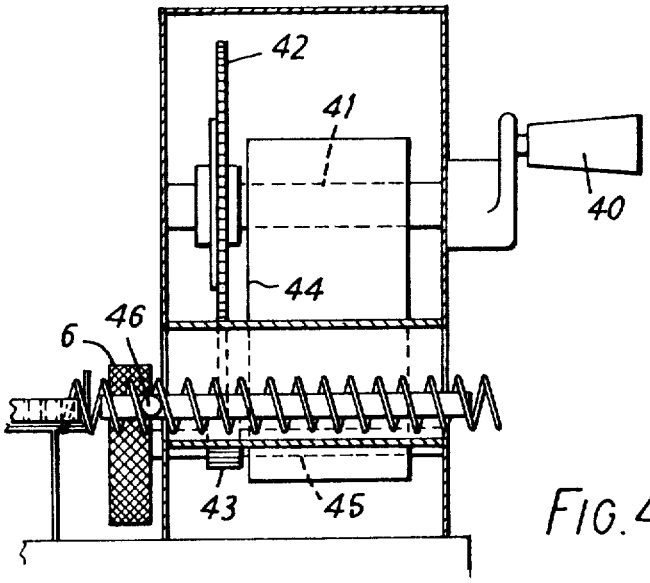
Figure 5:
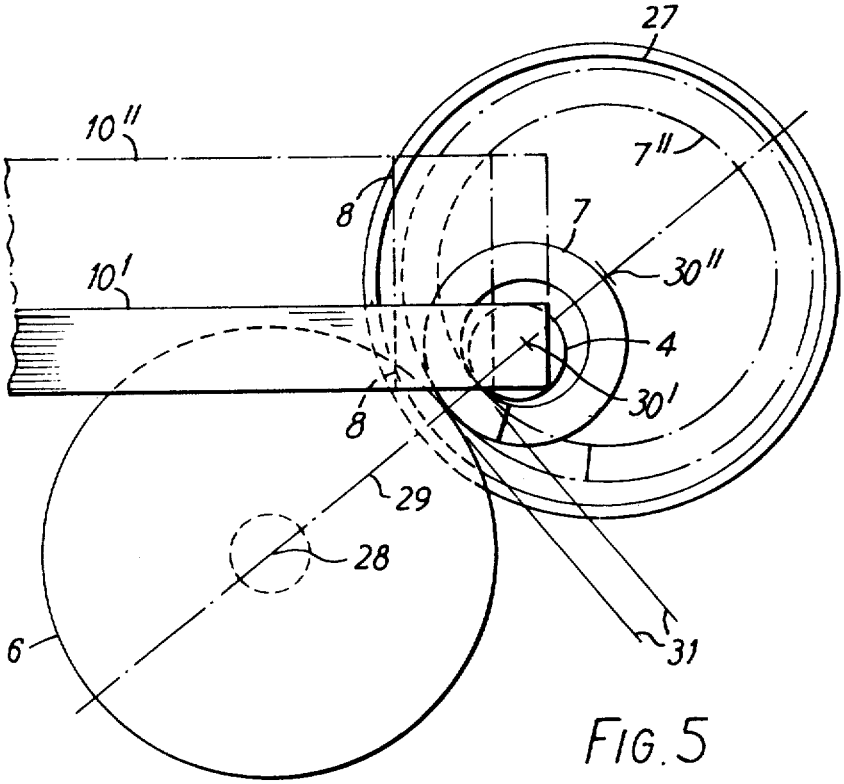

FIG. 2*a* is a view similar to a part of FIG. 1 showing a modification thereof;

FIG. 3 is a side elevational cross-section on the line III—III in FIG. 2;

FIG. 4 is a view similar to FIG. 3 of a manual version of the machine of FIG. 1; and FIG. 5 is a diagrammatic end elevation of the driving wheel and mandrel of the machine of FIG. 1.

Referring first to FIG. 1, the spiral binding machine can be seen to have a feeder 1 and a table 2 on a common base 3. A mandrel 4 supported in the feeder by a thin support 5 and a driving wheel 6 guide and feed a spiral binding element 7 into perforations 8 provided in a row along the front edge of sheets 10 on the table 2, an end guide 11 and a back guide 12 positioning the sheets.

As the spiral binding element is fed in the direction of arrow 13, turn 7*a* will react against the support 5 on one side of the mandrel 4, thereby locating the element longitudinally of the mandrel 4. On the other side, the turn 7*a* is engaged by the driving wheel 6 as is the next turn 7*b*. The next turn 7*c* is free while the next turn 7*d* enters the first perforation 8'. As shown, the leading end of the element 7 is about to enter the perforations 8', being part of the turn 7*d*. It may thus be seen that it is important that the perforation 8' and the support 5 are spaced apart by 3½ pitches of the spiral plus an allowance for the thickness of the spirals. To accommodate variations in the distance from the edge of sets of sheets abutted against guide 11 and the perforation 8', unshown table adjustment means may be provided. So far as adjustment laterally of the mandrel 4 is concerned, it is important that the side of the spiral binding element guided by the mandrel should be in alignment with the perforation 8'. This adjustment is provided by the adjustable back guide 12.

Referring now to FIGS. 2 and 3, the driving wheel 6 can be seen to be carried on an axle 14 journalled in side plates 15, 16 of a gear train 17. A motor 18 fixed to plate 16 provides the drive input to the gear train. This sub-assembly 6, 14, 15, 16, 17 and 18 is supported by pivot shaft 19 at the top thereof. The shaft 19 extends between side walls 20 of the feeder 1. Offset from the pivot shaft 19 at the back of the side plates, a biasing weight 21 is provided which swings the sub-assembly as an arm about the pivot pin 19 until an extension 22 at the bottom of the side plates abuts against cross-tie 23 between the side walls 20. In this position the driving wheel just clears, with clearance c, the mandrel when a spiral binding element is not in position. This prevents the driving wheel from damaging the mandrel as might occur when the end of an element is reached and the motor 18 is still switched on. For controlling the motor, a switch 24 is provided with an operating press bar 25. A power on indicating light 26 is provided on top of the feeder.

Instead of having a knurled periphery, driving wheel 6 may be provided with a rubber tire 6a as indicated in FIG. 2a.

A tube 27 extends between the side-plates around the mandrel 4 for passing the element 7 through the feeder. The mandrel is eccentric with respect to the tube to permit the driving wheel to position the varying overall diameters of different size spiral binding elements correctly for varying numbers of sheets to be bound, as is shown in FIG. 5. The driving wheel's central axis 28 in its driving position, is slightly below the mandrel's central axis, the plane 29 containing these central axes inclining upwardly from the mandrel away from the driving wheel.

A spiral binding element is light in comparison with the biasing force urging the driving wheel towards the mandrel, and thus the element will be lifted up so that its central axis indicated at 30', 30'' in FIG. 5 is positioned in the plane, at least in the region—along the length of the mandrel—of the driving wheel and first perforation 8 to be entered. Tangents 31 to the driving wheel, element and mandrel are all perpendicular to the plane at their points of mutual contact. FIG. 5 shows a small diameter spiral binding element 7' and a large diameter element 7'' held up by the driving wheel. The effect of this is that the ends of the element approach the end perforations 8 of the corresponding thicknesses of sheets 10', 10'' in the correct position, thus obviating the need to adjust the binding machine for varying thicknesses. All that is required is that the correct diameter of element be used. The above described machine has a mandrel of a diameter slightly less than 6 mm to feed a 6 mm internal diameter element and can also feed elements of up to 15 mm I.D..

FIG. 4 shows a manual feeder which may be used in place of the electrically driven feeder 1 of FIGS. 1, 2 and 3. The manual feeder has a handle 40 attached to one end of a shaft 41 from which is pivotally supported a swinging arm 44. The driving wheel 6 is attached to an axle 45 journalled at the lower end of the arm. A gear wheel 42 is fixed to shaft 41 and meshes with a pinion 43 fixed on the axle 45, whereby turning of the handle 41 rotates the driving wheel 6. Due to friction, principally between the steel shaft 41 and the swinging arm 44, which is preferably of polytetrafluoroethylene, turning of the handle in the direction for forward feeding of a spiral binding element urges the driving wheel against the element.

In contrast with the thin support 5 of the electrically driven feeder, the manual feeder has a support pin 46 supporting the mandrel 4 which has a diameter equal to the gap between two adjoining turns of the spiral binding element.

The invention is not intended to be restricted to the details of the above described machines. In particular, instead of relying on the driving wheel to lift the spiral binding element to align it with the sheets to be bound, the mandrel may have a diameter to closely fit in the element. Where different sizes of element are to be used a number of correspondingly sized mandrels may be provided. These mandrels may be mutually parallel, mounted on a carrier which is rotatable to bring a required mandrel into alignment with the tube 27. Conveniently the carrier has a shaft extending between the side plates parallel to the mandrels about which shaft the carrier is rotatable, and the shaft carries a spring biassing the carrier towards the driving wheel-side side plate, registers being provided in the side plate for receiving pointed ends of the mandrels whereby the carrier is held in position.

What is claimed is:

1. A spiral binding machine for spirally feeding a spiral binding element, said machine comprising: a fixed structure, a stationary mandrel supported on said fixed structure for supporting a spiral binding element received thereon; a driving wheel mounted in said machine for rotating a spiral binding element on said mandrel by gripping said element between the periphery of said driving wheel and said mandrel, the periphery of said driving wheel being frictionally engagable with said element; a single support pin connected to said mandrel and by which the mandrel is supported on said fixed structure, said mandrel having a plain ungrooved cylindrical external surface, said pin extending between adjacent turns of the spiral binding element for, in operation of the machine, being in direct contact with a turn of the element and providing the entire axial reaction contact of the machine with the element; said machine having an open unobstructured space on the opposite side of said pin from said driving wheel for accommodating different size spiral binding elements; and means for rotating said driving wheel.

2. A spiral binding machine as claimed in claim 1 wherein said driving wheel is displaceably mounted and means is provided for biasing said driving wheel towards said mandrel.

3. A spiral binding machine as claimed in claim 2 further comprising a stop on said structure preventing said driving wheel from displacing into contact with said mandrel when said element has been fed past said driving wheel.

4. A spiral binding machine as claimed in claim 2 further comprising a pivot in said machine and a swinging arm suspended from said pivot and having said driving wheel rotatably carried thereon below said pivot for displaceable mounting of said driving wheel.

5. A spiral binding machine as claimed in claim 4 wherein said biasing means is an offset weight carried on said arm.

6. A spiral binding machine as claimed in claim 4 wherein said means for rotating said driving wheel includes an electric motor carried on said arm.

7. A spiral binding machine as claimed in claim 4 wherein said means for rotating said driving wheel comprises:

a shaft providing said pivot;

a crank-handle attached to said shaft;

a gear wheel attached to said shaft;

an axle rotatably supported in said arm for carrying said driving wheel; and a pinion attached to said axle and meshed with said gear wheel for drivingly connecting said crank-handle to said driving wheel;

and friction in said rotating means provides said biasing means.

8. A spiral binding machine as claimed in claim 1 wherein said periphery of said driving wheel is knurled.

9. A spiral binding machine as claimed in claim 1 including a rubber tire carried on said periphery of said driving wheel.

10. A spiral binding machine as claimed in claim 1 further comprising a table for supporting a stack of sheets to be bound and having perforations along one edge for receiving said spiral binding element, and guides on said table for positioning said sheets so that said element can be spirally fed into said perforations.

11. A spiral binding machine as claimed in claim 10 wherein said guides are adjustable.

12. A spiral binding machine as claimed in claim 10 wherein said driving wheel has a central axis and said mandrel has a central axis, said central axes being in a plane inclined downwardly from said central axis of said mandrel when said driving wheel is biased against a spiral binding element on said mandrel.

13. A spiral binding machine as claimed in claim 12, further comprising a tubular guide for passing the binding element therethrough, said tubular guide having the lengthwise axis thereof disposed in said plane and encircling the mandrel and is eccentrically disposed with respect to the mandrel, the tubular guide having the part of the internal surface thereof nearest to the mandrel at the line of contact between the driving wheel and the spiral binding element.

* * * * *